US009329511B2

(12) United States Patent
Yamanaka et al.

(10) Patent No.: US 9,329,511 B2
(45) Date of Patent: May 3, 2016

(54) ELECTROSTATIC CHARGE IMAGE DEVELOPING TONER AND TONER CONTAINER

(71) Applicant: FUJI XEROX CO., LTD., Tokyo (JP)

(72) Inventors: Kiyohiro Yamanaka, Kanagawa (JP); Soichiro Kitagawa, Kanagawa (JP); Tomohiro Shinya, Kanagawa (JP); Shinpei Takagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 11 days.

(21) Appl. No.: 14/288,011

(22) Filed: May 27, 2014

(65) Prior Publication Data

US 2015/0050590 A1 Feb. 19, 2015

(30) Foreign Application Priority Data

Aug. 19, 2013 (JP) ..... 2013-169962

(51) Int. Cl.

| | |
|---|---|
| ***G03G 9/093*** | (2006.01) |
| ***G03G 9/087*** | (2006.01) |
| ***G03G 9/08*** | (2006.01) |

(52) U.S. Cl.

CPC ..... *G03G 9/08755* (2013.01); *G03G 9/0821* (2013.01); *G03G 9/08793* (2013.01); *G03G 9/08795* (2013.01); *G03G 9/08797* (2013.01); *G03G 9/09314* (2013.01); *G03G 9/09357* (2013.01)

(58) Field of Classification Search

CPC ..... G03G 9/08755; G03G 9/08793

See application file for complete search history.

(56) References Cited

FOREIGN PATENT DOCUMENTS

| | | |
|---|---|---|
| JP | A-2004-29522 | 1/2004 |
| JP | A-2010-191115 | 9/2010 |
| JP | A-2010-271606 | 12/2010 |
| JP | A-2013-11644 | 1/2013 |

*Primary Examiner* — Peter Vajda

(74) *Attorney, Agent, or Firm* — Oliff PLC

(57) ABSTRACT

An electrostatic charge image developing toner includes toner particles containing an amorphous resin and a crystalline resin, wherein when a softening temperature is measured at 30 points in surface layer parts of the toner particles, a difference ($T_H$(° C.)−$T_L$(° C.)) between a maximum value ($T_H$(° C.)) and a minimum value ($T_L$(° C.)) out of the softening temperatures at the 30 points is from 25° C. to 100° C.

12 Claims, 2 Drawing Sheets

ELECTROSTATIC CHARGE IMAGE DEVELOPING TONER AND TONER CONTAINER

CROSS-REFERENCE TO RELATED APPLICATIONS

This application is based on and claims priority under 35 USC 119 from Japanese Patent Application No. 2013-169962 filed Aug. 19, 2013.

BACKGROUND

Technical Field

The present invention relates to an electrostatic charge image developing toner and a toner container.

SUMMARY

According to an aspect of the invention, there is provided an electrostatic charge image developing toner including:

toner particles containing an amorphous resin and a crystalline resin, wherein when a softening temperature is measured at 0.30 points in surface layer parts of the toner particles, a difference ($T_H$(° C.)−$T_L$(° C.)) between a maximum value ($T_H$(° C.)) and a minimum value ($T_L$(° C.)) out of the softening temperatures at the 30 points is from 25° C. to 100° C.

BRIEF DESCRIPTION OF THE DRAWINGS

Exemplary embodiments of the present invention will be described in detail based on the following figures, wherein.

DETAILED DESCRIPTION

Figure 1:
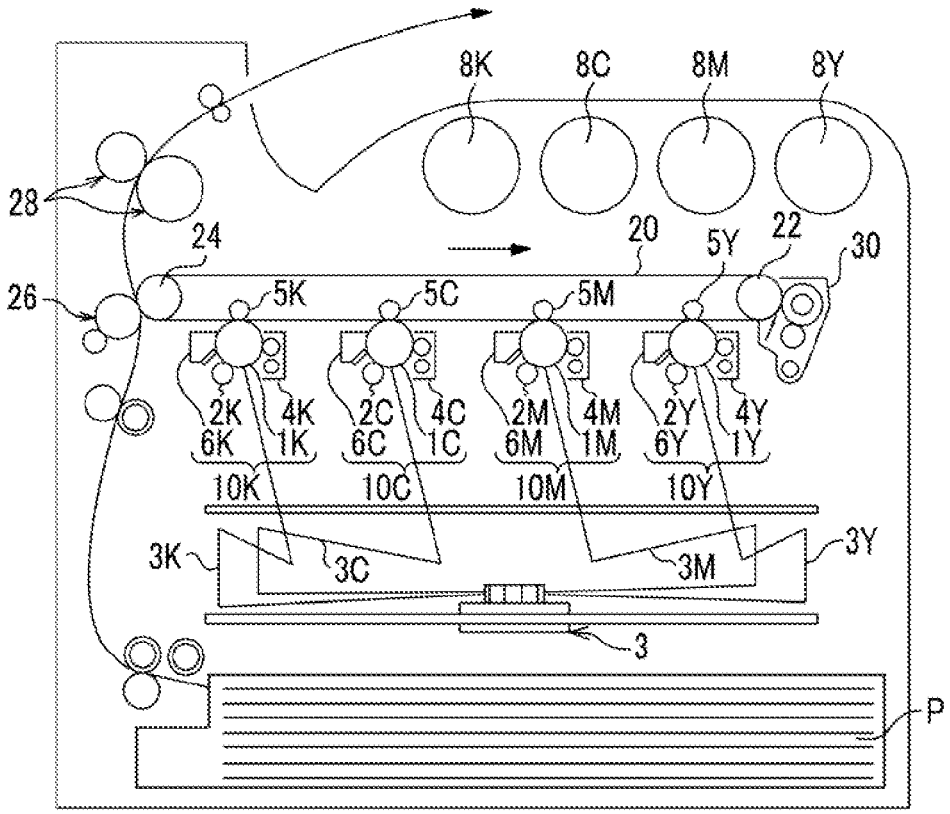
FIG. 1 is a schematic diagram showing a configuration of an example of an image forming apparatus according to an exemplary embodiment.

Hereinafter, exemplary embodiments of the invention will be described in detail.

Electrostatic Charge Image Developing Toner

An electrostatic charge image developing toner according to an exemplary embodiment (hereinafter, may be referred to as "toner") has toner particles containing an amorphous resin and a crystalline resin, and when a softening temperature is measured at 30 points in surface layer parts of the toner particles, a difference ($T_H$(° C.)−$T_L$(° C.)) between a maximum value ($T_H$(° C.)) and a minimum value ($T_L$(° C.)) out of the softening temperatures at the 30 points is from 25° C. to 100° C.

Here, the term "surface layer part" means a region ranging from the outermost surface of a toner particle within 50 nm deep.

The softening temperatures at the 30 points are values obtained by, for example, measurement at 30 points at regular intervals along the outer circumference of the cross-section of the toner particle in a region ranging from the outermost surface of the toner particle within 50 nm deep, through micro-region thermomechanical analysis of the cross-section of the toner particle using a micro-heating probe.

Examples of the method of obtaining the cross-section of the toner particle include the following method. Specifically, first, toner particles are buried using a bisphenol A liquid epoxy resin and a curing agent, and then a sample for cutting is prepared. Next, using a cutter using a diamond knife, for example, a LEICA Ultramicrotome (manufactured by Hitachi Technologies and Services, Ltd.), the sample for cutting is cut at a temperature of −100° C. to prepare a sample for observation.

The micro-region thermomechanical analysis using a micro-heating probe is performed using, for example, a system (resolving power: 20 nm) in which a local thermal analysis system (manufactured by Anasys Instruments Corporation, nano-TA) is installed in a scanning probe microscope (manufactured by Veeco Instruments Inc., MMAFM-type multi-mode SPM unit). Specifically, for example, the micro-heating probe of the local thermal analysis system is brought into contact with a measurement point of a sample (the cross-section of the toner) and the temperature is increased (a rate of temperature rise: 5° C./s) to observe the inclination of the micro-heating probe varying according to the softening of the sample to thus obtain a softening temperature in a micro-region of the measurement point.

The measurement is performed on five toner particles. Maximum values of the softening temperatures at the 30 points of the respective toner particles are averaged and the average thereof is set as the maximum value ($T_H$(° C.)). Minimum values of the softening temperatures at the 30 points of the respective toner particles are averaged and the average thereof is set as the minimum value ($T_L$(° C.)). In addition, a difference between the maximum value ($T_H$(° C.)) and the minimum value ($T_L$(° C.)) is the difference ($T_H$(° C.)−$T_L$(° C.)).

In this exemplary embodiment, as described above, the difference ($T_H$(° C.)−$T_L$(° C.)) between the maximum value ($T_H$(° C.)) and the minimum value ($T_L$(° C.)) is from 25° C. to 100° C. Therefore, compared to a case in which the difference ($T_H$(° C.)−$T_L$(° C.)) is less or greater than the foregoing range, low-temperature fixability is secured and toner fluidity is obtained. The reasons thereof are not clear, but presumed as follows.

It is thought that in a case of a toner having a small variation in the softening temperature over the entire surface of the toner particle (that is, the difference ($T_H$(° C.)−$T_L$(° C.)) is less than the foregoing range), toner fluidity is difficult to obtain when a resin having a low softening temperature is used to secure low-temperature fixability, and low-temperature fixability is difficult to obtain when a resin having a high softening temperature is used.

In addition, using an external additive is also considered to obtain fluidity. For example, in a case of a toner in which an external additive is externally added to toner particles containing a fixing aid such as a release agent, the release agent and the like may ooze out to the surface, together with temperature increase or humidity decrease in a developing machine occurring due to continuous image formation. In that case, it is thought that the external additive is unevenly distributed in the region where the release agent and the like ooze out to the surface, and the amount of the external additive that exists in other regions is reduced, whereby the effect of the external additive is not exhibited, the surfaces of the toner particles are exposed, and thus toner fluidity deteriorates. It is thought that when the toner fluidity deteriorates, for example, the number of contacts between the toner and the carrier is reduced, it is difficult for the toner after continuous output of high-density images to maintain charging properties, and thus image density is reduced.

In this exemplary embodiment, the difference ($T_H$(° C.)−$T_L$(° C.)) is within the foregoing range. That is, in this exemplary embodiment, there is an appropriate variation in the softening temperature in the surface of the toner particle, and regions having a high softening temperature and regions having a low softening temperature exist.

Therefore, it is thought that since the regions having a low softening temperature exist, low-temperature fixability of the toner is secured, and since the regions having a high softening temperature exist, toner fluidity is also obtained.

Particularly, it is thought that in a toner in which an external additive is externally added to toner particles containing a release agent and the like as described above, the oozing of the release agent and the like is suppressed at least in the regions having a high softening temperature. In addition, for example, even when the release agent oozes out to the regions having a low softening temperature, and thus the external additive is unevenly distributed and the surfaces of the toner particles are exposed in other regions, the exposed surfaces are regions having a high softening temperature, whereby it is presumed that toner fluidity is secured.

In the fixing of the toner to a recording medium, in addition to the fact that the regions having a low softening temperature are easily melted by heating, the release agent and the like contained in the toner particles easily ooze out of the regions having a low softening temperature, and thus it is presumed that low-temperature fixability is also realized.

As described above, in this exemplary embodiment, it is presumed that low-temperature fixability is secured and toner fluidity is obtained compared to a case in which the difference ($T_H$(° C.)−$T_L$(° C.)) is less than the foregoing range.

It is thought that in a case of a toner having a too large variation in the softening temperature (that is, the difference ($T_H$(° C.)−$T_L$(° C.)) is greater than the foregoing range), regions having a too high softening temperature or regions having a too low softening temperature exist in surfaces of toner particles. It is thought that when the regions having a too high softening temperature exist, low-temperature fixability of the toner deteriorates, and thus low-temperature fixability is difficult to obtain even when regions having a low softening temperature exist in other regions. In addition, it is thought that when the regions having a too low softening temperature exist, toner fluidity deteriorates, and thus the fluidity is difficult to obtain even when regions having a high softening temperature exist in other regions.

Therefore, in this exemplary embodiment, it is presumed that low-temperature fixability is secured and toner fluidity is obtained compared to a case in which the difference ($T_H$(° C.)−$T_L$(° C.)) is greater than the foregoing range.

In this exemplary embodiment, in addition to the fact that the difference ($T_H$(° C.)−$T_L$(° C.)) is within the foregoing range, it is preferable that a maximum value ($T_H$(° C.)), an intermediate value ($T_M$(° C.)), and a minimum value ($T_L$(° C.)) out of the softening temperatures at the 30 points satisfy the following Expression (1).

$$(T_H-T_M)<(T_M-T_L) \quad \text{Expression (1)}$$

Here, the intermediate value out of the softening temperatures at the 30 points means the 15-th value when the softening temperatures at the 30 points obtained by the measurement are arranged in ascending order. The measurement is performed on five toner particles. 15-th values of the respective toner particles are averaged and the average thereof is set as the intermediate value ($T_M$(° C.)).

In this exemplary embodiment, the difference ($T_H$(° C.)−$T_L$(° C.)) is within the foregoing range and the Expression (1) is satisfied, and thus low-temperature fixability is secured and toner fluidity is obtained compared to a case in which the Expression (1) is not satisfied. The reasons thereof are not clear, but presumed as follows.

In the toner satisfying the Expression (1), the intermediate value ($T_M$(° C.)) is closer to the maximum value ($T_H$(° C.)) than to the minimum value ($T_L$(° C.)). That is, the toner satisfying the Expression (1) is a toner in which many of the softening temperatures at the 30 points are distributed around high temperatures. Therefore, it is presumed that a balance between low-temperature fixability and toner fluidity is easily obtained since the number of the regions having a high softening temperature is larger than the number of the regions having a low softening temperature, in addition to the fact that both of the regions having a high softening temperature and the regions having a low softening temperature absolutely exist as described above.

In this exemplary embodiment, examples of the method of realizing the adjustment of the difference ($T_H$(° C.)−$T_L$(° C.)) within the foregoing range include a method of subjecting surface layer parts of toner particles to a crosslinking treatment (polymerization using a polymerization initiator) using, as the amorphous resin, an amorphous resin having an ethylenically unsaturated double bond (hereinafter, may be referred to as "unsaturated amorphous resin") and an amorphous resin having no ethylenicaily unsaturated double bond (hereinafter, may be referred to as "saturated amorphous resin") in combination.

That is, examples of the toner according to this exemplary embodiment include a toner containing a crosslinked product of the unsaturated amorphous resin and the saturated amorphous resin in surface layer parts of toner particles.

When the toner particles have a core and a coating layer (shell layer), for example, the surface layer parts of the toner particles may be subjected to the crosslinking treatment using, as a resin of the coating layer, the unsaturated amorphous resin and the saturated amorphous resin in combination. In that case, as a binder resin in the core, at least a crystalline resin may be used, or a crystalline resin and an amorphous resin may be used in combination. The kinds of the crystalline resin and the amorphous resin are not particularly limited.

In addition, when the toner particles have no coating layer, the surface layer parts of the toner particles may be subjected to the crosslinking treatment using, as an amorphous resin of the binder resin, the unsaturated amorphous resin and the saturated amorphous resin in combination. In that case, the kind of the crystalline resin used in the binder resin is not particularly limited.

When the unsaturated amorphous resin and the saturated amorphous resin are used in combination, examples of the method of controlling the value of the difference ($T_H$(° C.)−$T_L$(° C.)) within the foregoing range include a method of adjusting the amount of functional group having an ethylenically unsaturated double bond in the unsaturated amorphous resin and a method of adjusting the degree of crosslinking in the surface layer parts (the temperature or crosslinking time in the crosslinking treatment).

Examples of the method of performing control so that the intermediate value ($T_M$(° C.)) satisfies the Expression (1) include a method of adjusting a mixing ratio between the unsaturated amorphous resin and the saturated amorphous resin.

In this exemplary embodiment, the difference ($T_H$(° C.)−$T_L$(° C.)) is preferably from 25° C. to 100° C., and more preferably from 27° C. to 98° C.

Hereinafter, the toner according to this exemplary embodiment will be described in detail.

The toner according to this exemplary embodiment includes toner particles, and if necessary, an external additive.

Toner Particles

The toner particles contain, for example, a binder resin, and if necessary, a colorant, a release agent, and other additives.

Binder Resin

Examples of the binder resin include vinyl resins formed of homopolymers of monomers such as styrenes (e.g., styrene, parachlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used singly or in combination of two or more kinds thereof.

In this exemplary embodiment, as the binder resin, an amorphous resin and a crystalline resin are used in combination.

The content of the crystalline resin is preferably from 2% by weight to 40% by weight (preferably from 2% by weight to 20% by weight) with respect to the entire binder resin.

The "crystalline" resin indicates one having not a stepwise change in the amount of heat absorbed, but a clear heat absorption peak in differential scanning calorimetry (DSC). Specifically, it indicates that the half value width of a heat absorption peak measured at a rate of temperature rise of 10 (° C./min) is within 10° C.

The "amorphous" resin indicates one having a half value width of a heat absorption peak exceeding 10° C., exhibiting a stepwise change in the amount of heat absorbed, or having no clear heat absorption peak.

In this exemplary embodiment, as described above, the difference ($T_H$(° C.)−$T_L$(° C.)) is within the foregoing range, and examples of such toner particles include toner particles containing the unsaturated amorphous resin and the saturated amorphous resin as the amorphous resin and having a surface layer part subjected to a crosslinking treatment (that is, toner particles containing the crystalline resin and further containing the saturated amorphous resin and a crosslinked product of the unsaturated amorphous resin in the surface layer part).

Hereinafter, as an example of the toner particles included in the toner according to this exemplary embodiment, toner particles containing the crystalline resin and containing the saturated amorphous resin and a crosslinked product of the unsaturated amorphous resin in the surface layer part will be described. However, the toner particles are not limited to this form.

The unsaturated amorphous resin is not particularly limited as long as it is an amorphous resin having an ethylenically unsaturated double bond. The saturated amorphous resin is not particularly limited as long as it is an amorphous resin having no ethylenically unsaturated double bond. In this exemplary embodiment, an amorphous polyester resin is appropriate as any of the unsaturated amorphous resin and the saturated amorphous resin.

In this exemplary embodiment, a crystalline polyester resin is appropriate as the crystalline resin.

Hereinafter, an amorphous polyester resin will be described as an example of the unsaturated amorphous resin and the saturated amorphous resin, and a crystalline polyester resin will be described as an example of the crystalline resin. However, the unsaturated amorphous resin, the saturated amorphous resin, and the crystalline resin are not limited thereto.

Amorphous Polyester Resin

Examples of the amorphous polyester resin include condensation polymers of polyvalent carboxylic acids and polyols. A commercially available product or a synthesized product may be used as the amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing 3 crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyols may be used singly or in combination of two or more kinds thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "testing methods for transition temperatures of plastics".

The weight-average molecular weight (Mw) of the amorphous polyester resin is preferably from 5,000 to 1,000,000, and more preferably from 7,000 to 500,000.

The number-average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight-average molecular weight and the number-average molecular weight are measured by gel permeation chromatography (GPC). The molecular weight measurement by GPC is performed using GPC HLC-8120, manufactured by Tosoh Corporation as a measuring device, Column TSK gel Super HM-M (15 cm), manufactured by Tosoh Corporation, and a THF solvent. The weight-average molecular weight and the number-average molecular weight are calculated using a molecular weight calibration curve plotted from a monodisperse polystyrene standard sample from the results of the foregoing measurement.

A known preparing method is used to manufacture the amorphous polyester resin. Specific examples thereof include a method of conducting a reaction at a polymerization temperature set to from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Unsaturated Amorphous Polyester Resin

Examples of the amorphous polyester resin having an ethylenically unsaturated double bond (unsaturated amorphous polyester resin) include condensation polymers of polyvalent carboxylic acids and polyols, that are condensation polymers of monomers in which at least one of the polyvalent carboxylic acid and the polyol has a functional group having an ethylenically unsaturated double bond (e.g., a vinyl group, a vinylene group, and a crosslinkable functional group having a C═C bond).

From the viewpoint of stability, the unsaturated amorphous polyester resin may be a condensation polymer of a polyvalent carboxylic acid having a functional group having an ethylenically unsaturated double bond and the polyol, and preferably a condensation polymer of a dicarboxylic acid having a functional group having an ethylenically unsaturated double bond and the diol, that is, a linear polyester resin.

Examples of the dicarboxylic acid having an ethylenically unsaturated double bond include fumaric acid, maleic acid, maleic anhydride, citraconic acid, mesaconic acid, itaconic acid, glutaconic acid, allyl malonic acid, isopropylidene succinic acid, acetylenedicarboxylic acid, and lower alkyl esters (having from 1 to 4 carbon atoms) thereof.

Examples of the polyvalent carboxylic acid other than the dicarboxylic acid having an ethylenically unsaturated double bond include aconitic acid, 3-butene-1,2,3-tricarboxylic acid, 4-pentene-1,2,4-tricarboxylic acid, 1-pentene-1,1,4,4-tetracarboxylic acid, and lower alkyl esters (having from 1 to 4 carbon atoms) thereof.

These polyvalent carboxylic acids may be used singly or in combination of two or more kinds thereof.

Among the unsaturated amorphous polyester resins that are condensation polymers of polyvalent carboxylic acids and polyols, condensation polymers of at least one kind of dicarboxylic acid selected from fumaric acid, maleic acid, and maleic anhydride and diols are particularly preferably used. That is, the ethylenically unsaturated double bond of the amorphous polyester resin is preferably a site derived from at least one kind of dicarboxylic acid selected from fumaric acid, maleic acid, and maleic anhydride. The site derived from at least one kind of dicarboxylic acid selected from fumaric acid, maleic acid, and maleic anhydride is preferably included, since the unsaturated amorphous polyester resin is partially crosslinked and the surface layer parts of the toner particles are formed.

Crosslinked Product of Unsaturated Amorphous Polyester Resin

The crosslinked product of the unsaturated amorphous polyester resin is one in which the ethylenically unsaturated double bond part of the unsaturated amorphous polyester resin is formed by bonding by a polymerization reaction with a polymerization initiator.

Saturated Amorphous Polyester Resin

Examples of the amorphous polyester resin having no ethylenically unsaturated double bond (saturated amorphous polyester resin) include polyester resins other than the unsaturated amorphous polyester resin, and examples thereof include condensation polymers of polyvalent carboxylic acids having no ethylenically unsaturated double bond and polyols.

Mixing Ratio Between Unsaturated Amorphous Polyester Resin and Saturated Amorphous Polyester Resin As described above, examples of the method of controlling the value of the difference ($T_H$(° C.)−$T_L$(° C.)) within the foregoing range include a method of adjusting the amount of functional group having an ethylenically unsaturated double bond in the unsaturated amorphous resin and a method of adjusting the degree of crosslinking in the surface layer parts (the temperature or crosslinking time in the crosslinking treatment). Appropriate values of the amount of functional group having an ethylenically unsaturated double bond in the unsaturated amorphous resin and the degree of crosslinking in the surface layer parts vary according to the form of the toner particles, the kind of the resin, and the like.

In addition, examples of the method of performing control so that the intermediate value ($T_M$(° C.)) satisfies the Expression (1) include a method of adjusting a mixing ratio between the unsaturated amorphous resin and the saturated amorphous resin. An appropriate value of the mixing ratio between the unsaturated amorphous resin and the saturated amorphous resin varies according to the form of the toner particles, the kind of the resin, and the like.

Specifically, for example, when the toner particles have a core and a coating layer and a polyester resin is used as the unsaturated amorphous resin and the saturated amorphous resin in the coating layer, as for the amount of functional group having an ethylenically unsaturated double bone in the unsaturated amorphous resin, the ratio of a polyvalent carboxylic acid having the functional group having an ethylenically unsaturated double bond in the entire carboxylic acid components is, for example, from 5% by mol to 100% by mol, and preferably from 10% by mol to 100% by mol.

The ratio of the unsaturated amorphous resin in the entire amorphous resins of the coating layer is, for example, from 5% by weight to 95% by weight, and preferably from 10% by weight to 90% by weight.

When the mixing ratio is too low, the intermediate value (T*M*(° C.)) is reduced, and thus powder fluidity may be reduced. From that viewpoint, the mixing ratio (the ratio of the unsaturated amorphous resin in the entire amorphous resin of the coating layer) is preferably from 30% by weight to 100% by weight, and more preferably from 50% by weight to 95% by weight.

In addition, for example, when the toner particles do not have the coating layer and a polyester resin is used as the unsaturated amorphous resin and the saturated amorphous resin, the ratio of the unsaturated amorphous resin in the entire amorphous resins is preferably the same as in the toner surface layer part when the toner particles have the coating layer.

Crystalline Polyester Resin

Examples of the crystalline polyester resin include polycondensates of polyvalent carboxylic acids and polyols. A commercially available product or a synthesized product may be used as the crystalline polyester resin.

Here, as the crystalline polyester resin, a polycondensate using a polymerizable monomer having a linear aliphatic group is preferably used rather than a polymerizable monomer having an aromatic group, in order to easily form a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, naphthalene-2,6-dicarboxylic acid, malonic acid, and mesaconic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination together with a dicarboxylic acid. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used singly or in combination of two or more kinds thereof.

Examples of the polyol include aliphatic diols (e.g., linear aliphatic diols having from 7 to 20 carbon atoms in a main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferably used as the aliphatic diol.

As the polyol, a tri- or higher-valent polyol employing a crosslinked structure or a branched structure may be used in combination together with diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of the aliphatic diol may be 80% by mol or greater, and preferably 90% by mol or greater.

The melting temperature of the crystalline polyester resin is preferably from 50° C. to 100° C., more preferably from 55° C. to 90° C., and even more preferably from 60° C. to 85° C.

The melting temperature is obtained from "melting peak temperature" described in the method of obtaining a melting temperature in JIS K 7121-1987 "testing methods for transition temperatures of plastics", from a DSC curve obtained by differential scanning calorimetry (DSC).

The weight average molecular weight (Mw) of the crystalline polyester resin is preferably from 6,000 to 35,000.

For example, a known preparing method is used to manufacture the crystalline polyester resin as in the case of the amorphous polyester resin.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entire toner particles.

Release Agent

Examples of the release agent include, but are not limited to, hydrocarbon waxes; natural waxes such as carnauba wax, rice wax, and candelilla wax; synthetic or mineral/petroleum waxes such as montan wax; and ester waxes such as fatty acid esters and montanic acid esters.

The melting temperature of the release agent is preferably from 50° C. to 110° C., and more preferably from 60° C. to 100° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin, and if necessary, other additives such as a colorant and a release agent and a coating layer containing a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as (D84p/D16p).

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \qquad \text{Expression}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) anda cleaning activator (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry process (e.g., kneading and pulverizing method) and a wet process (e.g., aggregation and coalescence method, suspension and polymerization method, and dissolution and suspension method). The toner particle preparing method is not particularly limited to these processes, and a known process is employed.

Among these, the toner particles are preferably obtained by an aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

For example, when toner particles having no coating layer, containing a crystalline resin, and containing a crosslinked product of an unsaturated amorphous resin and a saturated amorphous resin in a surface layer part as described above are prepared by an aggregation and coalescence method, the toner particles having no coating layer are prepared through the processes of: preparing a resin particle dispersion in which resin particles containing a crystalline resin, an unsaturated amorphous resin, and a saturated amorphous resin (resin particles as a binder resin) are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); heating the aggregated particle dispersion in which the aggregated particles are dispersed, to coalesce the aggregated particles, thereby forming uncrosslinked toner particles (coalescence process); and adding a polymerization initiator to the uncrosslinked toner particle dispersion in which the uncrosslinked toner particles are dispersed, to form a crosslinked product of the unsaturated amorphous resin in surface layer parts of the uncrosslinked toner particles (crosslinked product forming process).

For example, when toner particles having a core and a coating layer, containing a crystalline resin, and containing a crosslinked product of an unsaturated amorphous resin and a saturated amorphous resin in a surface layer part are prepared by an aggregation and coalescence method, the toner particles having a core and a coating layer are prepared through the processes of: preparing a first resin particle dispersion in which first resin particles containing at least a crystalline resin (resin particles as a binder resin of the core) are dispersed (first resin particle dispersion preparation process); aggregating the first resin particles (if necessary, other particles) in the first resin particle dispersion (if necessary, in the dispersion after mixing with other particle dispersions) to form first aggregated particles (first aggregated particle forming process); mixing a second resin particle dispersion in which second resin particles containing an unsaturated amorphous resin and a saturated amorphous resin (resin particles as the coating layer) are dispersed with the first aggregated particle dispersion in which the first aggregated particles are dispersed, to conduct aggregation so that the second resin particles adhere to surfaces of the first aggregated particles, thereby forming second aggregated particles (second aggregated particle forming process); heating the second aggregated particle dispersion in which the second aggregated particles are dispersed, to coalesce the second aggregated particles, thereby forming uncrosslinked toner particles (coalescence process); and adding a polymerization initiator to the uncrosslinked toner particle dispersion in which the uncrosslinked toner particles are dispersed, to form a crosslinked product of the unsaturated amorphous resin in surface layer parts of the uncrosslinked toner particles (crosslinked product forming process).

Hereinafter, the respective processes will be described in detail.

In the following description, a method of obtaining toner particles containing a colorant and a release agent will be described, but the colorant and the release agent are used if necessary. Additives other than the colorant and the release agent may be used.

First, a general toner particle preparing method will be described.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as sulfuric ester salt-based, sulfonate-based, phosphate-based, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyol-based nonionic surfactants. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated at a temperature that is equal to or lower than the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

In addition, when toner particles having no coating layer, containing a crystalline resin, and containing a crosslinked product of an unsaturated amorphous resin and a saturated amorphous resin in a surface layer part as described above are prepared, resin particles containing a crystalline resin, an unsaturated amorphous resin, and a saturated amorphous resin are used as the resin particles as the binder resin.

After uncrosslinked toner particles are obtained in the coalescence process, the toner particles having no coating layer are prepared through the process of: adding a polymerization initiator to the uncrosslinked toner particle dispersion in which the uncrosslinked toner particles are dispersed, to form a crosslinked product of the unsaturated amorphous resin in surface layer parts of the uncrosslinked toner particles (crosslinked product forming process).

In addition, when toner particles having a core and a coating layer, containing a crystalline resin, and containing a crosslinked product of an unsaturated amorphous resin and a saturated amorphous resin in a surface layer part are prepared, first resin particles containing at least a crystalline resin are used as the resin particles as the binder resin.

After an aggregated particle dispersion in which aggregated particles are dispersed is obtained, the toner particles having a core and a coating layer are prepared through the processes of: further mixing the resin particle dispersion in which the resin particles as the coating layer are dispersed with the aggregated particle dispersion to conduct aggregation so that the resin particles further adhere to the surfaces of the aggregated particles, thereby forming second aggregated particles (second aggregated particle forming process); coalescing the second aggregated particles by heating the second aggregated particle dispersion in which the second aggregated particles are dispersed, thereby forming uncrosslinked toner particles having a core/shell structure (coalescence process); and adding a polymerization initiator to the uncrosslinked toner particle dispersion in which the uncrosslinked toner particles are dispersed, to form a crosslinked product of the unsaturated amorphous resin in surface layer parts of the uncrosslinked toner particles (crosslinked product forming process).

Hereinafter, the crosslinked product forming process will be described.

Crosslinked Product Forming Process

Next, a polymerization initiator is added to the uncrosslinked toner particle dispersion in which the uncrosslinked toner particles are dispersed, to allow the polymerization initiator to adhere to the surface layer parts of the uncrosslinked toner particles to thus conduct crosslinking of the ethylenically unsaturated double bond part of the unsaturated amorphous resin that exists in the surface layer parts of the uncrosslinked toner particles by a polymerization reaction, thereby forming a crosslinked product in the surface layer parts by crosslinking. That is, when radical polymerization is performed on the uncrosslinked toner particles using a polymerization initiator, toner particles having a crosslinked product of the unsaturated amorphous resin in surface layer parts are obtained.

The crosslinked product forming process is preferably performed as a subsequent process after the above-described coalescence process. This is because, when the aggregated particles are coalesced previously, the entire surfaces of the toner particles are easily subjected to the crosslinking treatment, and when the crosslinking treatment is performed before the coalescence, the formed crosslinked product may hinder the coalescence. Particularly, in the toner particles having a core and a coating layer, a case in which when the coating layer and the core are coalesced previously, the entire surfaces of the toner particles are easily subjected to the crosslinking treatment, and when the crosslinking treatment is performed before the coalescence, the formed crosslinked product hinders the coalescence by heat between the coating layer and the core is considered.

The reaction temperature in the formation of the crosslinked product may be, for example, from 50° C. to 100° C., and preferably from 60° C. to 90° C. The reaction time in the formation of the crosslinked product may be, for example, from 30 minutes to 7 hours, and preferably from 1 hour to 5 hours.

Examples of the polymerization initiator include water-soluble polymerization initiators and oil-soluble polymerization initiators.

Examples of the water-soluble polymerization initiators include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate (APS), sodium persulfate, potassium persulfate (KPS), diisopropyl peroxycarbonate, tetralin hydroperoxide, 1-phenyl-2-methy propyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, tert-butyl per-N-(3-toluyl) carbamate, ammonium bisulfate, and sodium bisulfate. These polymerization initiators may be used singly or in combination of two or more kinds thereof.

Examples of the oil-soluble polymerization initiators include azo polymerization initiators such as 2,2'-azobisisobutyronitrile, 2,2'-azobis(2,4-dimethylvaleronitrile), 1,1'-azobis(cyclohexane-1-carbonitrile), and 2,2'-azobis-4-methoxy-2,4-dimethylvaleronitrile.

Among these polymerization initiators, polymerization initiators that are dissolved in the solvent of the toner particle dispersion before crosslinking (the solvent is preferably water) are preferably used.

In addition, when a water-soluble polymerization initiator is used, crosslinking of the amorphous polyester resin having an ethylenically unsaturated double bond only in the outermost layer of the coating layer of the toner particle is easily conducted, and thus both of low-temperature fixability and mechanical strength of the toner particle are easily realized.

After the coalescence process (if necessary, the crosslinked product forming process) ends, the toner particles formed in the solution are subjected to a washing process, a solid-liquid separation process, and a drying process, that are well known, and thus dry toner particles are obtained.

In the washing process, preferably displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding and mixing an external additive with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:1.00 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a sur face of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, the image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four color toners, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration. So, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C. $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like, and as a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
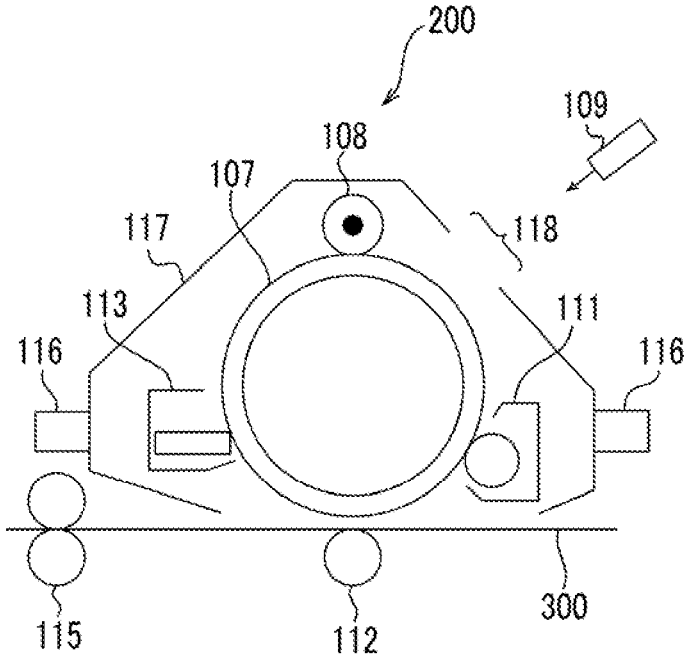
FIG. 2 is a schematic diagram showing a configuration of an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral. 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge (toner container) according to this exemplary embodiment will be described.

The toner cartridge according to this exemplary embodiment accommodates the toner according to this exemplary embodiment and is detachable from an image forming apparatus. The toner cartridge contains a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, this exemplary embodiment will be described in detail using examples, but is not limited to these examples. In the following description, unless specifically noted, "parts" and "%" are based on the weight.

Synthesis of Resin

Preparation of Crystalline Resin 45 parts by mol of 1,9-nonanediol, 55 parts by mol of sebacic acid, and 0.05 part by mol of dibutyltin oxide are put into a heated and dried three-necked flask. Then, nitrogen gas is supplied to the container so that the air in the container is kept under an inert atmosphere and the temperature is increased. Then, a co-condensation polymerization reaction is conducted for 2 hours at from 0.150° C. to 230° C., and then the obtained material is stirred for 10 hours with a slow temperature rise to 230° C. When the obtained material, is viscous, it is air-cooled to stop the reaction, whereby a crystalline polyester resin (crystalline resin) having a molecular weight of 10,000 and a melting temperature of 75° C. is synthesized.

Preparation of Saturated Amorphous Resin A 50 parts by mol of bisphenol A ethylene oxide (BPA-EO), 50 parts by mol of bisphenol A propylene oxide (BPA-PO), 75 parts by mol of terephthalic acid (TPA), 25 parts by mol of n-dodecenylsuccinic acid (DSA), and 0.1 parts by mci of dibutyltin oxide are put into a heated and dried two-necked flask. Nitrogen gas is supplied to the container so that the air in the container is kept under an inert atmosphere and the temperature is increased. Then, a co-condensation polymerization reaction is conducted for from 12 hours to 20 hours at from 150° C. to 230° C., and then the pressure is slowly reduced at from 210° C. to 250° C. Whereby, an amorphous polyester resin (saturated amorphous resin A) having a weight average molecular weight of 25,000 and a glass transition temperature (Tg) of 59° C. is synthesized.

Preparation of Unsaturated Amorphous Resin B 50 parts by mol of bisphenol A propylene oxide, 50 parts by mol of bisphenol A ethylene oxide, 56 parts by mol of terephthalic acid, 25 parts by mol of fumaric acid, 19 parts by mol of n-dodecenylsuccinic acid, and 0.1 part by mol of dibutyltin oxide are put into a heated and dried reaction container. Nitrogen gas is supplied to the container so that the air in the container is kept under an inert atmosphere and the temperature is increased. Then, a co-condensation polymerization reaction is conducted for from 12 hours to 20 hours at from 150° C. to 230° C., and then the pressure is slowly Reduced at from 210° C. to 250° C. Whereby, an amorphous polyester resin (unsaturated amorphous resin B) having an ethylenically unsaturated double bond and having a weight average molecular weight of 25,000 and a glass transition temperature (Tg) of 59° C. is synthesized.

Preparation of Unsaturated Amorphous Resin C 50 parts by mol of bisphenol A propylene oxide, 50 parts by mol of bisphenol A ethylene oxide, 38 parts by mol of terephthalic acid, 50 pares by mol of fumaric acid, 12 parts by mol of n-dodecenylsuccinic acid, and 0.1 part by mol of dibutyltin oxide are put into a heated and dried reaction container. Nitrogen gas is supplied to the container so that the air in the container is kept under an inert atmosphere and the temperature is increased. Then, a co-condensation polymerization reaction is conducted for from 12 hours to 20 hours at from 150° C. to 230° C., and then the pressure is slowly reduced at from 210° C. to 250° C. Whereby, an amorphous polyester resin (unsaturated amorphous resin C) having an ethylenically unsaturated double bond and having a weight average molecular weight of 25,000 and a glass transition temperature (Tg) of 58° C. is synthesized.

Preparation of Unsaturated Amorphous Resin D 50 parts by mol of bisphenol A propylene oxide, 50 parts by mol of bisphenol A ethylene oxide, 19 parts by mol of terephthalic acid, 75 parts by mol of fumaric acid, 6 parts by mol of n-dodecenylsuccinic acid, and 0.1 part by mol of dibutyltin oxide are put into a heated and dried reaction container. Nitrogen gas is supplied to the container so that the air in the container is kept under an inert atmosphere and the temperature is increased. Then, a co-condensation polymerization reaction is conducted for from 12 hours to 20 hours at from 150° C. to 230° C., and then the pressure is slowly reduced at from 210° C. to 250° C. Whereby, an amorphous polyester resin (unsaturated amorphous resin D) having an ethylenically unsaturated double bond and having a weight average molecular weight of 25,000 and a glass transition temperature (Tg) of 58° C. is synthesized.

Preparation of Resin Particle Dispersion

Preparation of Crystalline Resin Particle Dispersion 13,000 parts by weight of the obtained crystalline resin, 10,000 parts by weight of ion exchange water, and 90 parts by weight of sodium dodecylbenzenesulfonate are put into an emulsification tank of a high-temperature and high-pressure emulsification device (Cavitron CD1010), and then heated and melted at 130° C. Then, the obtained material is dispersed for 30 minutes at 110° C. at a flow rate of 3 L/m at 10,000 rpm and is allowed to pass through a cooling tank, whereby a crystalline polyester resin particle dispersion (crystalline resin particle dispersion) having a solid content of 30% and a volume average particle diameter D50v of 150 nm is prepared.

Preparation of Amorphous Resin Particle Dispersion

A saturated amorphous resin particle dispersion A, an unsaturated amorphous resin particle dispersion B, an unsaturated amorphous resin particle dispersion C, and an unsaturated amorphous resin particle dispersion D are obtained in the same manner as in the case of the preparation of the crystalline resin particle dispersion, except that the saturated amorphous resin A, the unsaturated amorphous resin B, the unsaturated amorphous resin C, and the unsaturated amorphous resin D are used in place of the crystalline resin, respectively.

Preparation of Colorant Particle Dispersion 45 parts by weight of carbon black (Regal 330, manufactured by Cabot Corporation), 5 parts by weight of an ionic surfactant Neogen R (Dai-ichi Kogyo Seiyaku Co., Ltd.), and 200 parts by weight of ion exchange water are mixed and dissolved, and then dispersed for 10 minutes using a homogenizer (IKA Ultra Turrax). The obtained material is subjected to a dispersion treatment using an ultimizer, and thus a colorant particle dispersion having a solid content of 20% and a central particle diameter of 245 nm is obtained.

Preparation of Release Agent Particle Dispersion 45 parts by weight of a paraffin wax (manufactured by Nippon Seiro Co., Ltd., HNP 0190), 5 parts by weight of an ionic surfactant Neogen R (manufactured by Dai-ichi Kogyo Seiyaku Co., Ltd.), and 200 parts by weight of ion exchange water are heated at 120° C. and subjected to a dispersion treatment using a pressure discharge Gaulin homogenizer, and thus a release agent particle dispersion having a solid content of 20% and a central particle diameter of 219 nm is obtained.

Example 1

Preparation of Toner Particles 1

420 parts by weight of the crystalline resin particle dispersion, 750 parts by weight of the saturated amorphous resin particle dispersion A, 125 parts by weight of the colorant dispersion, 250 parts by weight of the release agent dispersion, 2.5 parts by weight of aluminum sulfate (manufactured by Wako Pure Chemical industries, Ltd.), 0.5 part by weight of sodium dodecylbenzenesulfonate, 50 parts by weight of a 0.3 M nitric acid aqueous solution, and 500 parts by weight of ion exchange water are contained in a stainless-steel round flask and dispersed using a homogenizer (Ultra Turrax T-50, manufactured by Ika-Werke Gmbh & Co. Kg.). Then, the obtained material is heated to 50° C. in an oil bath for heating under stirring. It is kept at 50° C. and the formation of aggregated particles (first aggregated particles) having a volume average particle diameter of approximately 5.5 μm is confirmed.

Thereafter, 63 parts by weight of the saturated amorphous resin particle dispersion A and 188 parts by weight of the unsaturated amorphous resin particle dispersion B are additionally added, and then the obtained mixture is further kept for 30 minutes. Next, a 1 N sodium hydroxide aqueous solution is added thereto until the pH reaches 9.0. Then, the obtained material is heated to 80° C. under continuous stirring, and then kept for 1 hour for coalescence, thereby forming uncrosslinked toner particles 1.

After the formation of the uncrosslinked toner particles 1, a solution obtained by dissolving 25 parts by weight of potassium persulfate (KPS) in 200 parts by weight of ion exchange water is added to conduct a reaction for 3 hours at 80° C., and thus a crosslinked product is formed on surfaces of the toner particles.

The dispersion in which the toner particles having a crosslinked product on the surfaces thereof are dispersed is filtered. The resin particles remaining on the filter paper are re-dispersed by stirring with 500 parts by weight of deionized water, and the obtained material is further filtered for washing. The obtained particles are dried by a freeze dryer, and thus toner particles 1 are obtained.

With the obtained toner particles 1, a softening temperature is measured at 30 points through the above-described method. The maximum value ($T_H$(° C.)), the intermediate value ($T_M$(° C.)), the minimum value ($T_L$(° C.)), and the difference ($T_H$(° C.)−$T_L$(° C.)) are shown in Table 1.

Example 2

Preparation of Toner Particles 2

Uncrosslinked toner particles 2 are obtained in the same manner as in the case of the uncrosslinked toner particles 1, except that the additionally added unsaturated amorphous resin particle dispersion B in Example 1 is changed to the unsaturated amorphous resin particle dispersion D.

Toner particles 2 are obtained in the same manner as in the case of the toner particles 1, except that the uncrosslinked toner particles 2 are used in place of the uncrosslinked toner particles 1.

With the obtained toner particles 2, a softening temperature is measured at 30 points through the above-described method. The maximum value ($T_H$(° C.)), the intermediate value ($T_M$(° C.)), the minimum value ($T_L$(° C.)), and the difference ($T_H$(° C.)−$T_L$(° C.)) are shown in Table 1.

Example 3

Preparation of Toner Particles 3

Uncrosslinked toner particles 3 are obtained in the same manner as in the case of the uncrosslinked toner particles 1, except that the additionally added unsaturated amorphous resin particle dispersion B in Example 1 is changed to the unsaturated amorphous resin particle dispersion C.

Toner particles 3 are obtained in the same manner as in the case of the toner particles 1, except that the uncrosslinked toner particles 3 are used in place of the uncrosslinked toner particles 1.

With the obtained toner particles 3, a softening temperature is measured at 30 points through the above-described method. The maximum value ($T_K$(° C.)), the intermediate value ($T_M$(° C.)), the minimum value ($T_H$(° C.)), and the difference ($T_H$(° C.)−$T_L$(° C.)) are shown in Table 1.

Example 4

Preparation of Toner Particles 4

Toner particles 4 are obtained in the same manner as in the case of the toner particles 1, except that after the formation of the uncrosslinked toner particles 1 in Example 1, a solution obtained by dissolving 37.5 parts by weight of potassium persulfate (KPS) in 300 parts by weight of ion exchange water is added to conduct a reaction for 5 hours at 85° C., thereby forming a crosslinked product on surfaces of the toner particles.

With the obtained toner particles 4, a softening temperature is measured at 30 points through the above-described method. The maximum value ($T_H$(° C.)), the intermediate value ($T_H$(° C.)), the minimum value ($T_L$(° C.)), and difference ($T_H$(° C.)−$T_L$(° C.)) are shown in Table 1.

Example 5

Preparation of Toner Particles 5

Toner particles 5 are obtained in the same manner as in the case of the toner particles 1, except that the amount of the saturated amorphous resin particle dispersion A additionally added in Example 1 is changed to 225 parts by weight and the amount of the unsaturated amorphous resin particle dispersion B added in Example 1 is changed to 25 parts by weight.

With the obtained toner particles 5, a softening temperature is measured at 30 points through the above-described method. The maximum value ($T_H$(° C.)), the intermediate value ($T_M$(° C.)), the minimum value ($T_L$(° C.)), and the difference ($T_H$(° C.)−$T_L$(° C.)) are shown in Table 1.

Comparative Example 1

Preparation of Toner Particles 11

Uncrosslinked toner particles 11 are obtained in the same manner as in the case of the uncrosslinked toner particles 1, except that the amount of the saturated amorphous resin particle dispersion A additionally added in Example 2 is changed to 25 parts by weight and the amount of the unsaturated amorphous resin particle dispersion D added in Example 2 is changed to 225 parts by weight.

Toner particles 11 are obtained in the same manner as in the case of the toner particles 4, except that the uncrosslinked toner particles 11 are used in place of the uncrosslinked toner particles 4.

With the obtained toner particles 11, a softening temperature is measured at 30 points through the above-described method. The maximum value ($T_H$(° C.)), the intermediate value ($T_M$(° C.)), the minimum value ($T_L$(° C.)), and the difference ($T_H$(° C.)−$T_L$(° C.)) are shown in Table 1.

Comparative Example 2

Preparation of Toner Particles 12

Toner particles 12 are obtained in the same manner as in the case of the toner particles 5, except that after the formation of the uncrosslinked toner particles in Example 5, in place of the addition of a solution obtained by dissolving 25 parts by weight of potassium persulfate (KPS) in 200 parts by weight of ion exchange water to conduct a reaction for 3 hours at 80° C., a solution obtained by dissolving 10 parts by weight of potassium persulfate (KPS) in 100 parts by weight of ion exchange water is added to conduct a reaction for 1 hour at 75° C., thereby forming a crosslinked product on surfaces of the toner particles.

With the obtained toner particles 12, a softening temperature is measured at 30 points through the above-described method. The maximum value ($T_H$(° C.)), the intermediate value ($T_M$(*C)), the minimum value ($T_L$(° C.)), and the difference ($T_H$(° C.)−$T_L$(° C.)) are shown in Table 1.

Comparative Example 3

Toner Particles 13

As toner particles 13, the uncrosslinked toner particles 1 in Example 1 are directly used.

With the toner particles 13, a softening temperature is measured at 30 points through the above-described method. The maximum value ($T_H$(° C.)), the intermediate value ($T_M$(° C.)), the minimum value ($T_L$(° C.)), and the difference ($T_H$(° C.)−$T_L$(° C.)) are shown in Table 1.

Preparation of Toner

Preparation of Toners 1 to 5 and 11 to 13

1.5 parts by weight of hydrophobic silica (manufactured by Aerosil Nippon Co., Ltd., RY50) and 1.0 part by weight of hydrophobic titanium oxide (manufactured by Aerosil Nippon Co., Ltd., T805) are added to 50 parts by weight of the respective toner particles (toner particles 1 to 5 and 11 to 13) and are blended using a sample mill to obtain external additive-added toners (toners 1 to 5 and 11 to 13).

Preparation of Developer 100 parts of ferrite particles (manufactured by Powdertech Co., Ltd., average particle diameter: 50 μm) and 1.5 parts of a styrene-methyl methacrylate copolymer resin (molecular weight: 80,000) are put into a pressurizing kneader together with 500 parts of toluene, and are stirred to be mixed for 15 minutes at room temperature. Then, while the mixing is performed under reduced pressure, the temperature is increased to 70° C. to remove the toluene by distillation, and then the mixture is cooled and classified using a 105 μm sieve to obtain a resin-coated ferrite carrier.

This resin-coated ferrite carrier is mixed with each of the above-described external additive-added toners (toners 1 to 5 and 11 to 13), and thus two-component electrostatic charge image developers (developers 1 to 5 and 11 to 13) having a toner density of 8.5% by weight are prepared.

Evaluation

The respective obtained toners and developers are evaluated as follows. Table 1 shows the results thereof.

Powder Fluidity

The powder fluidity of the respective obtained toners is evaluated using a powder rheometer. Specifically, FT4, manufactured by Freeman Technology, Ltd., is used as the powder rheometer.

Each of the obtained developers is set in a modified machine of a DocuCentre Color 500, manufactured by Fuji Xerox Co., Ltd. (only a developing machine is operated), and the developing machine is operated for 3 hours under an environment of a temperature of 28° C. and a humidity of 85%. Then, the toner from which the carrier is separated with an elbow-jet classifier under an environment of a temperature of 22° C. and a humidity of 50% is set as a toner after developing machine operation, and a difference in total energy amount between before and after the operation of the developing machine is measured. The difference in total energy amount is measured as follows.

First, the toner is put into a 200 mL container having an internal diameter of 50 mm and a height of 140 mm. The rotary torque and the vertical load when a rotary vane is rotated at a tip end speed of 100 mm/s while being moved in the container at an approach angle of −5° in a height range of from 110 mm to 10 mm from the bottom surface, while allowing the air to flow in at an air flow rate of 50 ml/min are measured.

Next, an energy gradient (mJ/mm) with respect to a height H is obtained from the rotary torque or the vertical load with respect to the height H from the bottom surface, and the area obtained by integrating the energy gradient is set as a total energy amount (mJ). In the examples, the total energy amount is obtained by integrating a section in a height range of from 10 mm to 110 from the bottom surface.

In addition, the foregoing conditioning and energy measurement operation are performed 5 times and the results thereof are averaged in order to reduce the effect of an error.

As the rotary vane, a p 48 mm diameter blade having a two-vane propeller shape manufactured by Freeman Technology, Ltd. is used.

The evaluation standards are as follows.

G1: The difference in total energy amount (mJ) is less than 10 mJ.

G2: The difference in total energy amount (mJ) is from 10 mJ to less than 20 mJ.

G3: The difference in total energy amount (mJ) is from 20 mJ to less than 30 mJ.

G4: The difference in total energy amount (mJ) is from 30 mJ to less than 50 mJ.

G5: The difference in total energy amount (mJ) is 50 mJ or greater.

Low-Temperature Fixability (Minimum Fixing Temperature)

A developing machine of a modified machine of a DocuCentre Color 500, manufactured by Fuji Xerox Co., Ltd. (modified so that the fixing is performed by an external fixing machine with a variable fixing temperature), is filled with each of the developers 1 to 5 and 11 to 13. Using this apparatus, a solid toner image having a toner amount adjusted to 13.5 g/m$^2$ is formed on color paper (3 paper), manufactured by Fuji Xerox Co., Ltd. After the toner image is formed, the toner image is fixed at a fixing rate of 150 mm/sec under Nip of 6.5 mm using an external fixing machine.

The fixing temperature is increased from 130° C. by 5° C. to fix the toner image. The paper is folded inward at an approximately center of the solid part of the fixed image to wipe a part in which the fixed image is damaged with tissue paper, and the width of a white line is measured to perform the evaluation with the following evaluation standards.

The temperature at which the width of the white line is 0.4 mm or less is set as a minimum fixing temperature. The minimum fixing temperature is preferably 150° C. or lower, and particularly preferably 145° C. or lower.

Evaluation of Image Density Each of the obtained developers is set in a modified machine of a DocuCentre Color 500, manufactured by Fuji Xerox Co., Ltd. (modified so that a developing process speed is adjustable), and 50,000 solid images of 40 mm×50 mm are formed at a developing process speed of 200 mm/sec to measure the image densities of the first and 50,000-th images using an image densitometer (X-Rite 404A, manufactured by X-Rite Co.). From the results of the image density measurement, the evaluation is performed according to the following evaluation standards.

G1: The image density of the 50,000-th image is not less than 95% of the image density of the first image.

G2: The image density of the 50,000-th image is from 85% to less than 95% of the image density of the first image.

G3: The image density of the 50,000-th image is from 70% to less than 85% of the image density of the first image.

G4: The image density of the 50,000-th image is less than 70% of the image density of the first image.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| Developer | 1 | 2 | 3 | 4 | 5 | 11 | 12 | 13 |
| Unsaturated Amorphous Resin | B | D | C | B | B | D | B | B |
| Ratio of Unsaturated Amorphous Resin in Entire Coating Layer (% by weight) | 75 | 75 | 75 | 75 | 10 | 90 | 10 | 75 |
| Crosslinking Treatment | Treated | Treated | Treated | Treated | Treated | Treated | Treated | Non-Treated |
| Maximum Value $T_H$ (° C.) | 118 | 191 | 157 | 163 | 122 | 210 | 111 | 95 |
| Intermediate Value $T_M$ (° C.) | 112 | 168 | 143 | 149 | 101 | 194 | 96 | 93 |
| Minimum Value $T_L$ (° C.) | 91 | 93 | 92 | 94 | 92 | 92 | 93 | 91 |
| Difference $T_H$ - $T_L$ (° C.) | 27 | 98 | 65 | 69 | 30 | 118 | 18 | 4 |
| Powder Fluidity | G3 | G1 | G2 | G2 | G4 | G1 | G5 | G5 |
| Minimum Fixing Temperature (° C.) | 135 | 150 | 140 | 145 | 135 | 165 | 135 | 130 |
| Image Density | G2 | G1 | G1 | G1 | G3 | G1 | G4 | G4 |

From the foregoing results, it is found that, in the examples, low-temperature fixability is secured and toner fluidity is obtained, and thus a reduction in image density after continuous output of high-density images is suppressed compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing:

an amorphous resin comprising:

an unsaturated amorphous resin; and a saturated amorphous resin, wherein the amorphous resin is a polyester resin; and a crystalline resin, wherein:

a surface layer of each of the toner particles comprises the saturated amorphous resin which is a crosslinked product of the unsaturated amorphous resin, and when a softening temperature is measured at 30 points in the surface layer of the toner particles, a difference ($T_H$(° C.)−$T_L$(° C.)) between a maximum value ($T_H$(° C.)) and a minimum value ($T_L$(° C.)) out of the softening temperatures at the 30 points is from 25° C. to 100° C.

2. The electrostatic charge image developing toner according to claim 1, wherein the maximum value ($T_H$(° C.)), an intermediate value ($T_M$(° C.)), and the minimum value ($T_L$(° C.)) out of the softening temperatures at the 30 points satisfy the following Expression (1):

$$(T_H-T_M)<(T_M-T_L). \quad \text{Expression (1):}$$

3. The electrostatic charge image developing toner according to claim 1, wherein the difference ($T_H$(° C.)−$T_L$(° C.)) is from 27° C. to 98° C.

4. The electrostatic charge image developing toner according to claim 1, wherein the toner particles have a core and a coating layer, and the coating layer comprises the surface layer.

5. The electrostatic charge image developing toner according to claim 1, wherein the crosslinked product of the unsaturated amorphous resin is present only in the surface layer.

6. The electrostatic charge image developing toner according to claim 4, wherein a ratio of the unsaturated amorphous resin in the entire amorphous resin of the coating layer is from 30% by weight to 100% by weight.

7. The electrostatic charge image developing toner according to claim 4, wherein a ratio of the unsaturated amorphous resin in the entire amorphous resin of the coating layer is from 50% by weight to 95% by weight.

8. A toner container containing the electrostatic charge image developing toner according to claim 1 and that is detachable from an image forming apparatus.

9. The electrostatic charge image developing toner according to claim 4, wherein:

the polyester resin has a carboxylic acid component, and a ratio of a polyvalent carboxylic acid having a functional group having an ethylenically unsaturated double bond in the entire carboxylic acid component is from 5% by mol to 100% by mol.

10. The electrostatic charge image developing toner according to claim 9, wherein the ratio of the polyvalent carboxylic acid having the functional group in the entire carboxylic acid component is from 10% by mol to 100% by mol.

11. The electrostatic charge image developing toner according to claim 1, wherein a content of the crystalline resin in the toner particles is from 2% by weight to 40% by weight.

12. The electrostatic charge image developing toner according to claim 11, wherein the content of the crystalline resin in the toner particles is from 2% by weight to 20% by weight.

* * * * *